US005575573A

United States Patent [19]

Ito et al.

[11] Patent Number: 5,575,573

[45] Date of Patent: Nov. 19, 1996

[54] DOCUMENT PROCESSING DEVICE HAVING FORMAT INFORMATION STORING FUNCTION

[75] Inventors: Chitoshi Ito, Kasugai; Yasushi Kawakami, Nagoya; Akihiro Sawada, Nagoya; Sachiyo Nakahigashi, Nagoya, all of Japan

[73] Assignee: Brother Kogyo Kabushiki Kaisha, Nagoya, Japan

[21] Appl. No.: 500,838

[22] Filed: Jul. 11, 1995

[30] Foreign Application Priority Data

Jul. 20, 1994 [JP] Japan ..... 6-191129

[51] Int. Cl.[6] ..... B41J 5/30

[52] U.S. Cl. ..... 400/76; 400/61; 400/62

[58] Field of Search ..... 400/4, 9, 61, 62, 400/70, 76, 582, 586, 615.2

[56] References Cited

U.S. PATENT DOCUMENTS 5,066,152 11/1991 Kuzuya et al. .

5,188,469 2/1993 Nagao et al. .

*Primary Examiner*—John S. Hilten

*Attorney, Agent, or Firm*—Oliff & Berridge

[57] ABSTRACT

A document processing device which includes an input device for inputting characters, symbols and various instructions; a display having a cursor; a text memory for storing input data, such as the characters and symbols; a print element for printing the input data stored in the text memory; and a controller for controlling the input device, the display and the print element also includes the ability to set a fixed format mode in order to print the input data in a fixed format; a non-volatile fixed format information memory containing prescribed preset fixed formats such that the input data input in the fixed format mode is stored; a format information memory which is provided in the text memory and serves to store format information to print the input data, and an ability to read in the fixed format information from the fixed format information memory and transmit it to the format information memory.

16 Claims, 20 Drawing Sheets

Fig.4

43

| | | |
|---|---|---|
| LABEL INDEX TABLE | -1 | HEAD ADDRESS OF "CALL REGISTERED FILE" ← LP |
| | 0 | HEAD ADDRESS OF "VIDEO VHS TAPE" |
| | 1 | HEAD ADDRESS OF "VIDEO 8mm&Hi8 CASE" |
| | 2 | HEAD ADDRESS OF "VIDEO 8mm&Hi8 TAPE" |
| | 3 | HEAD ADDRESS OF "VIDEO VHS–C TAPE" |
| | 4 | HEAD ADDRESS OF "VIDEO VHS–C CASE" |
| | 5 | HEAD ADDRESS OF "AUDIO CASSETTE TAPE" |
| | | ⋮ |
| LABEL INHERENT INFORMATION TABLE | | INHERENT DATA OF "VIDEO VHS TAPE" |
| | | INHERENT DATA OF "VIDEO 8mm&Hi8 TAPE" |
| | | INHERENT DATA OF "VIDEO 8mm&Hi8 CASE" |
| | | INHERENT DATA OF "VIDEO VHS–C TAPE" |
| | | INHERENT DATA OF "VIDEO VHS–C CASE" |
| | | ⋮ |
| LABEL NAME TABLE | | DISPLAY DATA OF "CALL FILE" |
| | | DISPLAY DATA OF "VIDEO VHS TAPE" |
| | | DISPLAY DATA OF "VIDEO 8mm&Hi8 TAPE" |
| | | DISPLAY DATA OF "VIDEO 8mm&Hi8 CASE" |
| | | DISPLAY DATA OF "VIDEO VHS–C TAPE" |
| | | DISPLAY DATA OF "VIDEO VHS–C CASE" |
| | | DISPLAY DATA OF "AUDIO CASSETTE TAPE" |
| | | ⋮ |
| INPUT INDICATION MESSAGE TABLE | | MESSAGE DISPLAY DATA OF "SYMBOL ?" |
| | | MESSAGE DISPLAY DATA OF "TITLE ?" |
| | | MESSAGE DISPLAY DATA OF "COMMENT ?" |
| | | MESSAGE DISPLAY DATA OF "RECORDING TIME" |
| | | MESSAGE DISPLAY DATA OF "STANDARD ?" |
| | | MESSAGE DISPLAY DATA OF "RECORDING DATE" |
| | | ⋮ |

Fig.6A

| LABEL NUMBER | FIXED –TYPE LABEL NAME | INPUT INDICATION MESSAGE | OPTIMUM TAPE WIDTH (mm) | | | | |
|---|---|---|---|---|---|---|---|
| | | | 6 | 9 | 12 | 18 | 24 |
| –1 | CALL REGISTERED FILE | TEXT DATA | SET TAPE WIDTH | | | | |
| 0 | VIDEO VHS TAPE | (1) SYMBOL ?, (2) TITLE ?, (3) COMMENT ?, (4) RECORDING TIME, (5) STANDARD ?, (6) RECORDING DATE | | | | ○ | |
| 1 | VIDEO 8mm&Hi8 TAPE | (1) SYMBOL ?, (2) TITLE ?, (3) COMMENT ? | | ○ | | | |
| 2 | VIDEO 8mm&Hi8 CASE | (1) SYMBOL ?, (2) TITLE ?, (3) COMMENT ?, (4) RECORDING TIME, (5) STANDARD ?, (6) RECORDING DATE | | | ○ | | |
| 3 | VIDEO VHS–C TAPE | (1) SYMBOL ?, (2) TITLE ? | | | ○ | | |
| 4 | VIDEO VHS–C CASE | (1) SYMBOL ?, (2) TITLE ?, (3) COMMENT ?, (4) RECORDING TIME, (5) STANDARD ?, (6) RECORDING DATE | | | | ○ | |
| 5 | AUDIO CASSETTE TAPE | (1) SYMBOL ?, (2) TITLE ?, (3) COMMENT ? | ○ | | | | |
| 6 | AUDIO CASSETTE CASE | (1) SYMBOL ?, (2) TITLE ?, (3) COMMENT ? | | | ○ | | |

Fig.6B

| | | | | | | | |
|---|---|---|---|---|---|---|---|
| 7 | AUDIO DATA TAPE | (1) SYMBOL ?, (2) TITLE ? | ○ | | | | |
| 8 | AUDIO DATA CASE | (1) SYMBOL ?, (2) TITLE ? | | | ○ | | |
| 9 | NAME PLATE LARGE | (1) SYMBOL ?, (2) TITLE ?, (3) COMMENT ? | | | | | ○ |
| 10 | NAME PLATE SMALL | (1) SYMBOL ?, (2) TITLE ? | | | | | ○ |
| 11 | MANAGEMENT EQUIPMENT LARGE | (1) ARTICLE NAME ?,<br>(2) MANAGEMENT NUMBER ?,<br>(3) MANAGEMENT SECTION?,<br>(4) COMPANY NAME ? | | | | | ○ |
| 12 | MANAGEMENT EQUIPMENT SMALL | (1) ARTICLE NAME ?,<br>(2) MANAGEMENT NUMBER ?,<br>(3) MANAGEMENT SECTION ? | | | ○ | | |
| ⋮ | ⋮ | ⋮ | | | | | |

Fig. 7B

| STEP | ACTION |
|---|---|
| START TEXT INPUT CONTROL | |
| S10 | KEY INPUT ? |
| S11 | PRINTABLE KEY INPUT ? |
| S12 | STORAGE AND DISPLAY PROCESSING OF DOCUMENT DATA |
| S13 | MEMORY KEY INPUT ? |
| S14 | DOCUMENT DATA REGISTER PROCESSING |
| S15 | PRINT KEY INPUT ? |
| S16 | PRINT PROCESSING |
| S17 | FIXED-TYPE LABEL FORMING KEY INPUT ? |
| S18 | FIXED-TYPE LABEL FORMING CONTROL |
| S19 | FIXED FORMAT ALTERING KEY INPUT ? |
| S20 | FIXED FORMAT INFORMATION ALTERING CONTROL |
| S21 | PROCESSING CORRESPONDING TO MANIPULATED KEY |

Fig. 8B

| STEP | ACTION |
|---|---|
| START FIXED-TYPE LABEL FORMING CONTROL | |
| S30 | READ IN TAPE CASSETTE INFORMATION |
| S31 | CASSETTE MOUNTED ? |
| S32 | DISPLAY ERROR MESSAGE |
| S33 | DISPLAY LABEL NAME SELECTION FRAME |
| S34 | LABEL NAME SELECTION CONTROL |
| S35 | FIXED-TYPE LABEL DATA INPUT PROCESSING |
| S36 | FIXED-TYPE LABEL FORMATION RELEASING KEY INPUT ? |
| S37 | FIXED FORMAT INFORMATION TRANSMISSION CONTROL |

Fig. 9B

| STEP | ACTION |
|---|---|
| START LABEL NAME SELECTION CONTROL | |
| S40 | CURSOR DOWN-SHIFT KEY INPUT ? |
| S41 | DISPLAY NEXT LABEL NAME |
| S42 | CURSOR UP-SHIFT KEY INPUT ? |
| S43 | DISPLAY PREVIOUS LABEL NAME |
| S44 | ENTER KEY INPUT ? |
| S45 | FIXED FORMAT INFORMATION DEVELOPMENT PROCESSING |
| S46 | CANCEL KEY INPUT ? |

Fig. 10B

| STEP | ACTION |
|---|---|
| START FIXED FORMAT INFORMATION ALTERING CONTROL | |
| S50 | DISPLAY FIRST ITEM OF OVERALL FORMAT INFORMATION |
| S51 | CURSOR DOWN-SHIFT KEY INPUT ? |
| S52 | DISPLAY NEXT ITEM OF OVERALL FORMAT INFORMATION |
| S53 | CURSOR UP-SHIFT KEY INPUT ? |
| S54 | DISPLAY PREVIOUS ITEM OF OVERALL FORMAT INFORMATION |
| S55 | ALTER AND SET OVERALL FORMAT INFORMATION THROUGH KEY MANIPULATION |
| S56 | LINE FORMAT KEY INPUT ? |
| S57 | END KEY INPUT ? |
| S58 | DISPLAY LINE FORMAT SETTING INITIAL FRAME |
| S59 | SIZE KEY INPUT ? |
| S60 | ALTER AND SET SIZE THROUGH KEY MANIPULATION (SIZE SETTING MODE) AND DISPLAY |
| S61 | DECORATION KEY INPUT ? |
| S62 | ALTER AND SET DECORATION THROUGH KEY MANIPULATION (DECORATION SETTING MODE) AND DISPLAY |
| S63 | FONT KEY INPUT ? |
| S64 | ALTER AND SET FONT THROUGH KEY MANIPULATION (FONT SETTING MODE) AND DISPLAY |
| S65 | OTHER FORMAT KEYS INPUT ? |
| S66 | ALTER AND SET THE OTHER FORMAT THROUGH KEY MANIPULATION (SETTING MODE OF THE OTHER FORMATS) AND DISPLAY |
| S67 | END KEY INPUT ? |

Fig.11

( OVERALL FORMAT INFORMATION )

| ITEM | PARAMETER |
|---|---|
| RULED LINE | NO<br>RECTANGULAR BORDER / SOLID LINE<br>RECTANGULAR BORDER / DOTTED LINE<br>RECTANGULAR BORDER / BROKEN LINE<br>CIRCULAR BORDER / SOLID LINE<br>TABLE RULE / SOLID LINE<br>TABLE RULE / DOTTED LINE<br>TABLE RULE / BROKEN LINE<br>CANDY<br>SOCCER<br>BUNCH OF FLOWERS<br>MEMORANDUM<br>BALLOON<br>NAMEPLATE<br>RIBBON |
| ARRANGEMENT | LEFT– JUSTIFICATION<br>RIGHT– JUSTIFICATION<br>CENTER– JUSTIFICATION<br>EQUATIONAL LAYOUT |
| BLANK | LARGE<br>NO<br>SMALL<br>MIDDLE |
| FIXED LENGTH | AUTO<br>20 TO 250mm ( ONE UNIT ) |
| CHARACTER PITCH | STANDARD<br>NARROW<br>WIDE |
| COLUMN ALIGNMENT | NO<br>YES |
| VERTICAL WRITING | NO<br>YES |
| MIRROR IMAGE | NO<br>YES |

Fig.12A ( LINE FORMAT INFORMATION )

| ITEM | | PARAMETER | |
|---|---|---|---|
| SIZE | HEIGHT | AUTO<br>SS (6 pt)<br>S (10 pt)<br>M (13 pt)<br>L (19 pt)<br>LL (26 pt)<br>VL (38 pt) | |
| | WIDTH | STANDARD (EM)<br>LONG (EN)<br>FLAT (DOUBLE) | |
| DECORATION | | NO<br>BOLD<br>BOX<br>SOLID<br>SHADOW<br>BOX SHADOW | |
| | ITALIC | NO<br>YES | |
| FONT | ENGLISH FONT | A<br>B<br>C<br>D<br>E<br>F | |
| | JAPANESE FONT | MING TYPE<br>GOTHIC TYPE<br>BRUSH–WRITING TYPE | |

Fig.12B

| | |
|---|---|
| SETTING | LEFT (LEFT–JUSTIFICATION)<br>RIGHT (RIGHT–JUSTIFICATION)<br>CENTER (CENTER–JUSTIFICATION)<br>EQUAL (EQUATIONAL LAYOUT) |
| VERTICAL WRITING | NO<br>YES |
| RULED LINE | NO<br>UNDERLINE / SOLID LINE<br>UNDERLINE / DOTTED LINE<br>UNDERLINE / BROKEN LINE<br>RECTANGULAR BORDER / SOLID LINE<br>RECTANGULAR BORDER / DOTTED LINE<br>RECTANGULAR BORDER / BROKEN LINE<br>CIRCULAR BORDER / SOLID LINE<br>ERASING LINE |

DOCUMENT PROCESSING DEVICE HAVING FORMAT INFORMATION STORING FUNCTION

BACKGROUND OF THE INVENTION

1. Field of the Invention

The invention relates to a document processing device, and particularly to a document processing device which is capable of altering a fixed format which is a print format to print document data.

2. Description of the Related Art

The applicant of this application previously proposed and put to practical use a tape-shaped label forming device including a keyboard, a display and a print mechanism having a thermal head, in which characters, such as letters and symbols, can be printed on a tape serving as a print target member (using tape widths of 9 mm, 12 mm or 24 mm, for example) through an ink ribbon to form a tape-shaped label which will be suitably stuck on the backbone of a file, as disclosed in U.S. Pat. No. 5,066,152.

Such a tape-shaped label, as described above, is not limited to a label which is to be stuck on the backbone of a file, but it may be applied to various types of labels, such as a label to be stuck on a video tape or its case, a label to be stuck on an audio tape or its case, a label for management which is to be stuck on books, and a nameplate label which is stuck onto stationery which is owned by an individual.

Further, a document processing device, such as an ordinary word processor or the like, is designed so that prescribed fixed format information is preset to print an address and a name on a post card, and then a printing operation is performed in a fixed format on the basis of the fixed format information. The same concept is applied to a case where various fixed-type labels are printed in a fixed format.

The fixed format is stored in a ROM of a controller and, in the conventional document processing device, the fixed format information cannot be altered because the fixed format information is read out to be subjected to a print processing every printing operation.

However, when it is desired that a printing operation be performed using a print format which could only be obtained by partially altering a fixed format, the print format cannot be formed because no alteration can be made to the fixed format as described above. Accordingly, the desired print format must be created. Thus, a heavy load is imposed on a format setting work for printing and a format setting efficiency is little improved. In particular, it is difficult for a beginner to set a print format and, in some cases, a beginner cannot effectively use the document processing device. Therefore, there are various disadvantages in use of the document processing device.

SUMMARY OF THE INVENTION

In view of the foregoing, in order to simply and rapidly prepare these different types of labels, the applicant of this application developed a new type tape-shaped label forming device as a prototype. In this tape-shaped label forming device, display information for displaying plural names, such as "video tape", "case of video tape", "audio tape", and "case of audio tape", and plural input indication messages, such as "title (record content)", "genre of record content", and "record date", which are associated with each of the label names, and fixed format information to print, in a prescribed fixed format, the text data which are input on the basis of each input indication message, are set in advance. The input indication messages for selected ones of the plural labels are successively displayed on a display. In addition, the text data which are input at the display of the input indication message are stored for every item identified by the input indication message and the text data are printed on a tape in accordance with the fixed format information.

An object of the invention goes further than the prototype and provides a document processing device which is capable of altering preset prescribed fixed format information and of preparing desired print format information.

According to one aspect of the invention, a document processing device which includes input means for inputting characters, symbols and various instructions; display means containing a display having a cursor; a text memory for storing input data, such as characters and symbols; print means for printing the input data stored in the text memory; and control means for controlling the input means, the display means and the print means, further includes fixed format mode setting means for setting a fixed format mode to print the input data in a fixed format, a non-volatile fixed format information memory in which fixed format information to print, in a prescribed preset fixed format, having the input data input in the fixed format mode is stored beforehand; a format information memory which is provided in the text memory and serves to store format information to print the input data; and format information transmission means for reading in the fixed format information from the fixed format information memory and transmitting it to the format information memory.

The document processing device, as described above, may be provided with mode releasing means for releasing the fixed format mode which is set by the fixed format mode setting means and transmitting the fixed format information to the format information transmission means.

The document processing device, as described above, may be further provided with format information altering control means for displaying on a display the fixed format information which is transmitted from the format information transmission means to the format information memory and allowing the fixed format information to be altered through the input means.

According to the document processing device as described above, the input means, the display means, the text memory, the print means and the control means for controlling the input means, the display means and the print means are provided. Further, the fixed format mode setting means sets the fixed format mode in which the input data are printed in a fixed format, and the non-volatile fixed format information memory beforehand stores the fixed format information with which the input data input in the fixed format mode are to be printed in the prescribed preset fixed format. The format information memory is provided in the text memory, and the format information for input data printing is stored in the format information memory. The format information transmission means reads the fixed format information from the fixed format information memory and transmits it to the format information memory.

According to the document processing device, the mode releasing means releases the fixed format mode which is set by the fixed format mode setting means, and instructs the fixed format information to the format information transmission means.

According to the document processing device, the format information altering control means displays on the display the fixed format information which is transmitted to the format information transmission means by the format information transmission means, and allows the fixed format information to be alterable through the input means.

BRIEF DESCRIPTION OF THE DRAWINGS

FIG. 4 is a table showing the data structure of the plurality of fixed labels which are stored in a ROM;

FIGS. 6A and 6B are a table showing fixed-type label names, input indication messages and optimum tape width;

FIG. 7B is a table of labels for FIG. 7A;

FIG. 8B is a table of labels for FIG. 8A;

FIG. 9B is a table of labels for FIG. 9A;

FIG. 10B is a table of labels for FIG. 10A;

FIG. 11 is a table showing the content of the overall format information for printing;

FIGS. 12A and 12B are a table showing the content of line format information for printing;

DETAILED DESCRIPTION OF THE PREFERRED EMBODIMENT

A preferred embodiment according to the invention will be described hereunder with reference to the accompanying drawings.

In the embodiment, the invention is applied to a tape-shaped label forming device in which many characters, such as Hiragana characters, Kanji characters, numbers, and symbols, are printed on a laminate tape (print tape) serving as a print target to thereby form a tape-shaped label.

Figure 1:
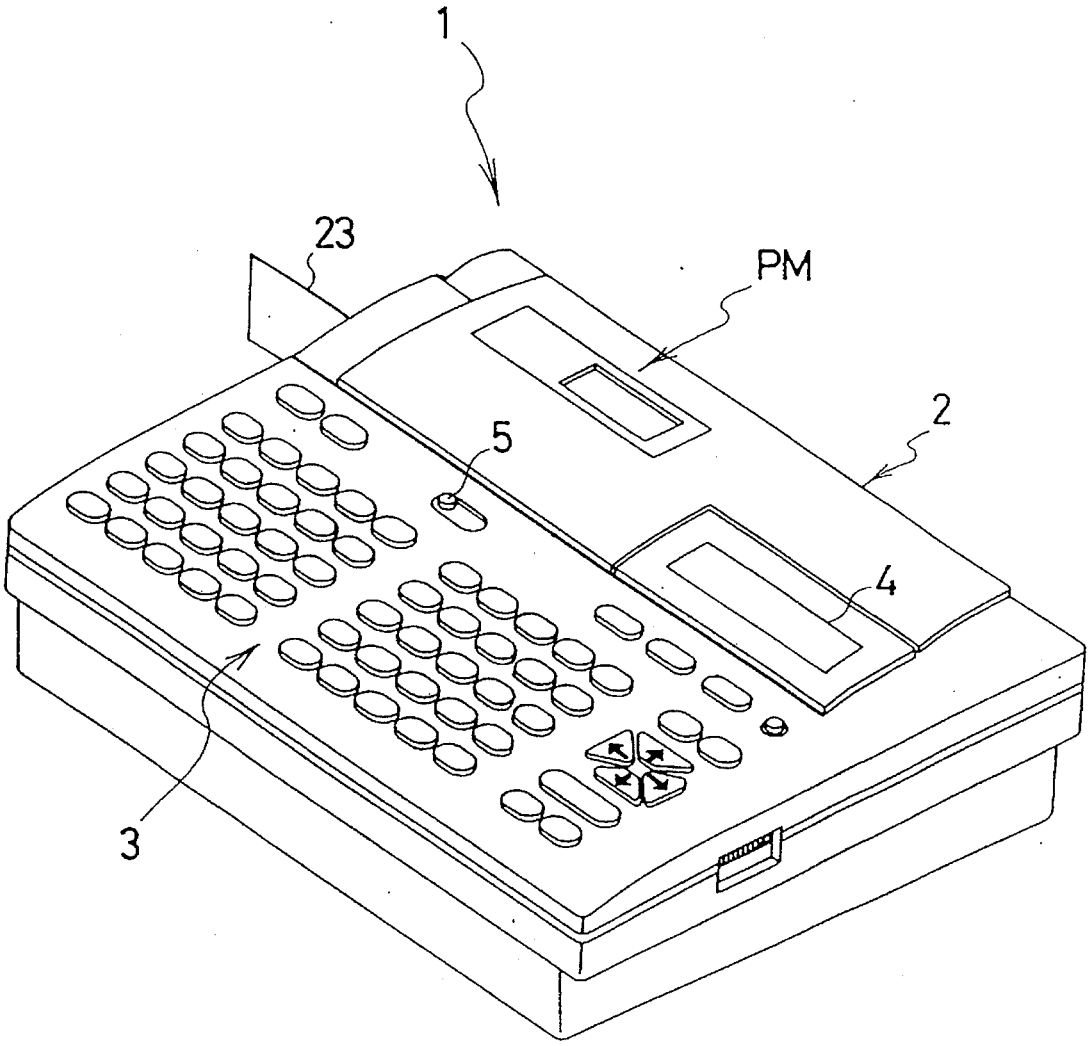
FIG. 1 is a perspective view showing a tape-shaped label forming device of an embodiment according to the invention.

As shown in FIG. 1, the tape-shaped label forming device 1 includes a keyboard 3 disposed at the front portion of a body frame 2, a thermal print mechanism PM which is behind the keyboard 3 in the body frame 2, and a liquid crystal display 4 which is disposed just behind the keyboard 3 and can display the input characters and/or symbols for two lines. Reference numeral 5 represents an operation lug for opening the cover case for the print mechanism PM.

The keyboard (corresponding to the input means) 3 is provided with character keys for inputting characters, such as alphabetic characters, numerals, and symbols; editing keys, such as a space key, a line feed key, cursor shift keys for shifting a cursor in the right-and-left and up-and-down directions respectively, a fixed-type label forming key for easily forming a label which is then stuck onto a video tape, an audio tape or a case therefor, a fixed format altering key, a fixed-type label formation releasing key, an enter key, and a cancel key; various keys for setting a print format; a print key for instructing a print operation; a power source key for turning on/off a power source, and other keys for performing functions not directed to the invention.

Figure 2:
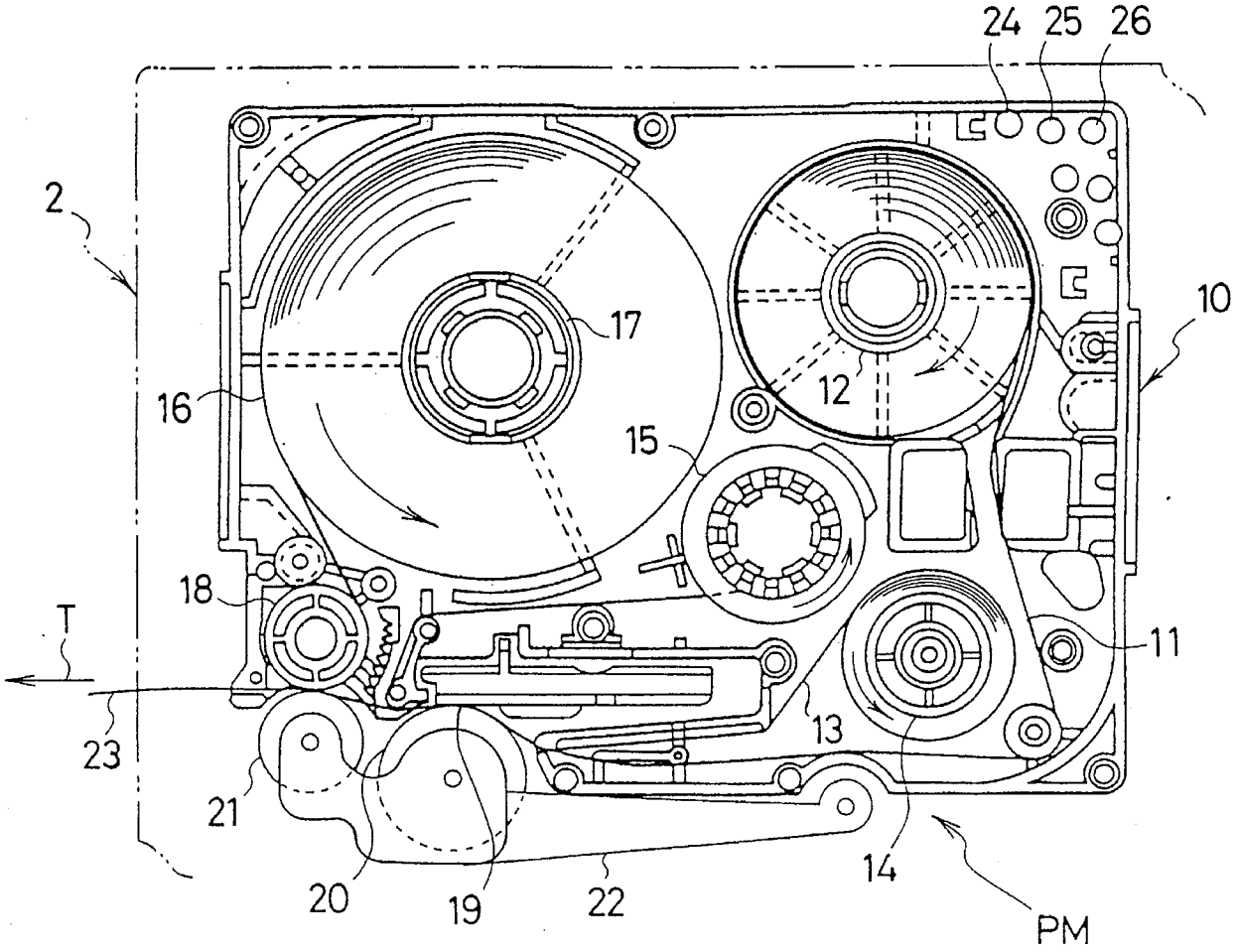
FIG. 2 is a plan view showing a thermal print mechanism in which a tape cassette is mounted.

The thermal print mechanism (corresponding to the print means) PM will be described with reference to FIG. 2. A rectangular tape cassette 10 is detachably mounted in the thermal print mechanism PM. The tape cassette 10 includes a tape spool 12 around which a laminate tape 11 serving as a print target is wound, a ribbon spool 14 around which an ink ribbon 13 is wound, a ribbon take-up spool 15 for taking up the ink ribbon 13, a supply spool 17 around which a pressure sensitive adhesive double coated tape 16 (hereinafter referred to as "double coated tape") having the same width as the laminate tape 11 is wound with its peel-off sheet facing outwardly, and a bonding roller 18 for pressing the laminate tape 11 and the double coated tape 16 against each other so that the two tapes are bonded to each other. The above spools 12, 14,15,17 and the roller 18 are freely, rotatably mounted on the tape cassette 10.

A thermal head 19 is vertically disposed at the position where the laminate tape 11 and the ink ribbon 13 are overlapped with each other. A platen roller 20, for pressing the laminate tape 11 and the ink ribbon 13 against the thermal head 19, and a feed roller 21 for feeding the tapes while pressing the laminate tape 11 and the double coated tape 16 against the bonding roller 18 to form the tape-shaped label, are pivotally and rotatably supported by a roller supporter 22 which is pivotally and rotatably mounted on the body frame 2. The thermal head 19 has an array of 128 heating elements in a direction vertical to the cassette tape, that is, the array of heating elements is transverse to the longitudinal axis of the laminate tape 11.

Accordingly, by driving a tape feed motor 36 (see FIG. 3) in a prescribed rotational direction, the bonding roller 18 and the ribbon take-up spool 15 are rotated in respective prescribed rotational directions in synchronism with each other. Through the rotation of the spools 18,15, characters and symbols are printed as a mirror image, as plural dot arrays, at the back surface side of the laminate tape 11 when the plural heating elements of the thermal head 19 are supplied with current, and the double coated tape 16 is bonded to the back surface side of the laminate tape 11, whereby a tape-shaped label 23 is formed. The tape-shaped label 23, thus formed, is fed in a tape feed direction T, and fed to the outside of the body frame 2 as shown in FIGS. 1 and 2.

The thermal print mechanism PM is described in detail in U.S. Pat. No. 5,188,469, the disclosure of which is incorporated herein by reference.

Used as the tape cassette 10 are five types of tape cassettes each having a laminate tape of a different width. For example, the laminate tape of the tape cassette is designed to have a width of one of 6 mm, 9 mm, 12 mm, 18 mm and 24 mm. In association with the difference in the tape cassette type, three detection holes 24 to 26 are formed in the bottom wall portion of the tape cassette 10. Some of the detection holes 24 to 26 are selectively closed to identify the one of the five types of tape cassettes, containing the size laminate tape loaded in the thermal print mechanism PM. A cassette sensor 30 (see FIG. 3) for detecting a tape width or a tape type on the basis of the combination of closed detection holes 24 to 26, and outputting the type tape cassette information, is secured to the body frame 2 which supports the lower side of the tape cassette 10.

Figure 3:
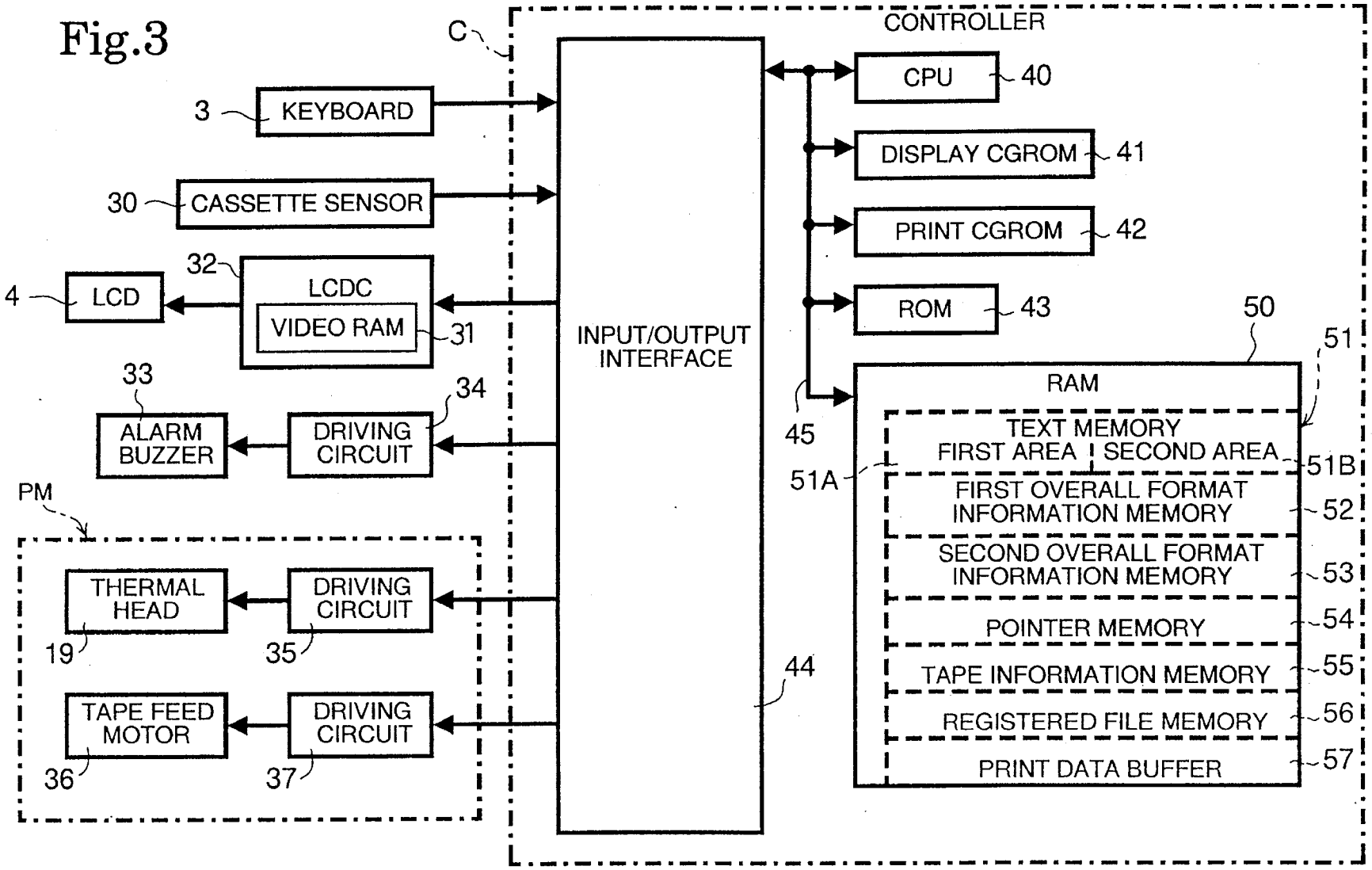
FIG. 3 is a block diagram showing a control system for the tape-shaped label forming device.

A control system for the tape-shaped label forming device 1 is structured as shown in the block diagram of FIG. 3. It will be described hereunder.

As shown in FIG. 3, connected to an input/output interface 44 of a controller C are the keyboard 3, the cassette sensor 30, a display controller (LCDC) 32 having a video RAM 31 for outputting display data to the liquid display (LCD) 4, a driving circuit 34 for driving an alarm buzzer 33, a driving circuit 35 for driving the thermal head 19, and a driving circuit 37 for driving the tape feed motor 36, respectively.

The controller C comprises a CPU 40, the input/output interface 44 which is connected to the CPU 40 through a bus 45, such as a data bus, a display character generator ROM (display CGROM) 41, a print character generator ROM (print CGROM) 42, a ROM 43 and a RAM 50.

In the display CGROM 41 are stored display dot pattern data of a prescribed character size for each of the many characters, such as alphabetic characters and symbols that can be displayed.

Stored in the print CGROM 42 are print dot pattern data of plural print character sizes for each of the many characters, such as alphabetic characters, numbers and symbols, in correspondence to code data of every format.

Stored in the ROM 43 are a display driving control program for controlling the display controller 32 in correspondence to the code data of the characters, such as characters, numbers and symbols input from the keyboard 3, a print driving control program for successively transmitting dot pattern data for each dot array to be printed to the thermal head 19 and the tape feed motor 36 for printing, and a control program for text input control and fixed-type label formation control, label name selection control, fixed-type label data input control, and fixed format information altering control as well as other programs.

The following label names are examples of label names usable as a label name which can be formed by the tape-shaped label forming device 1 as described above: "video VHS tape" which is used on a VHS video tape, "video 8 mm&Hi8 tape" which is used on a 8 mm video tape, "video 8 mm&Hi8 case" which is used on a case for the video tape, "video VHS-C tape" which is used on a compact type VHS video tape, "video VHS-C case" which is used on a case for the compact VHS video tape, and "audio cassette tape" which is used on an audio cassette tape. In addition, "call for registered file" with which a registered file registered through user's input setting is called as a label name is also provided.

As shown in FIG. 4, the ROM 43 is provided with a label index table in which the head address of label inherent information for label printing and the head address of a label name table are stored for each of the plurality of label names, label inherent information in which inherent data for each label are stored, a label name table in which display data to display label names are stored, and an input indication message table in which display data for plural input indication messages provided for the respective label names are stored. In the label index table, label numbers "−1", "0", "1","2",... which are inherent to the respective label names are stored with a one of the label numbers allocated to each of the plural label names. Since the plural label names are preset and fixedly stored in the ROM 43, the label names are referred to as "fixed label names" to discriminate them from registered label names.

Figure 5:
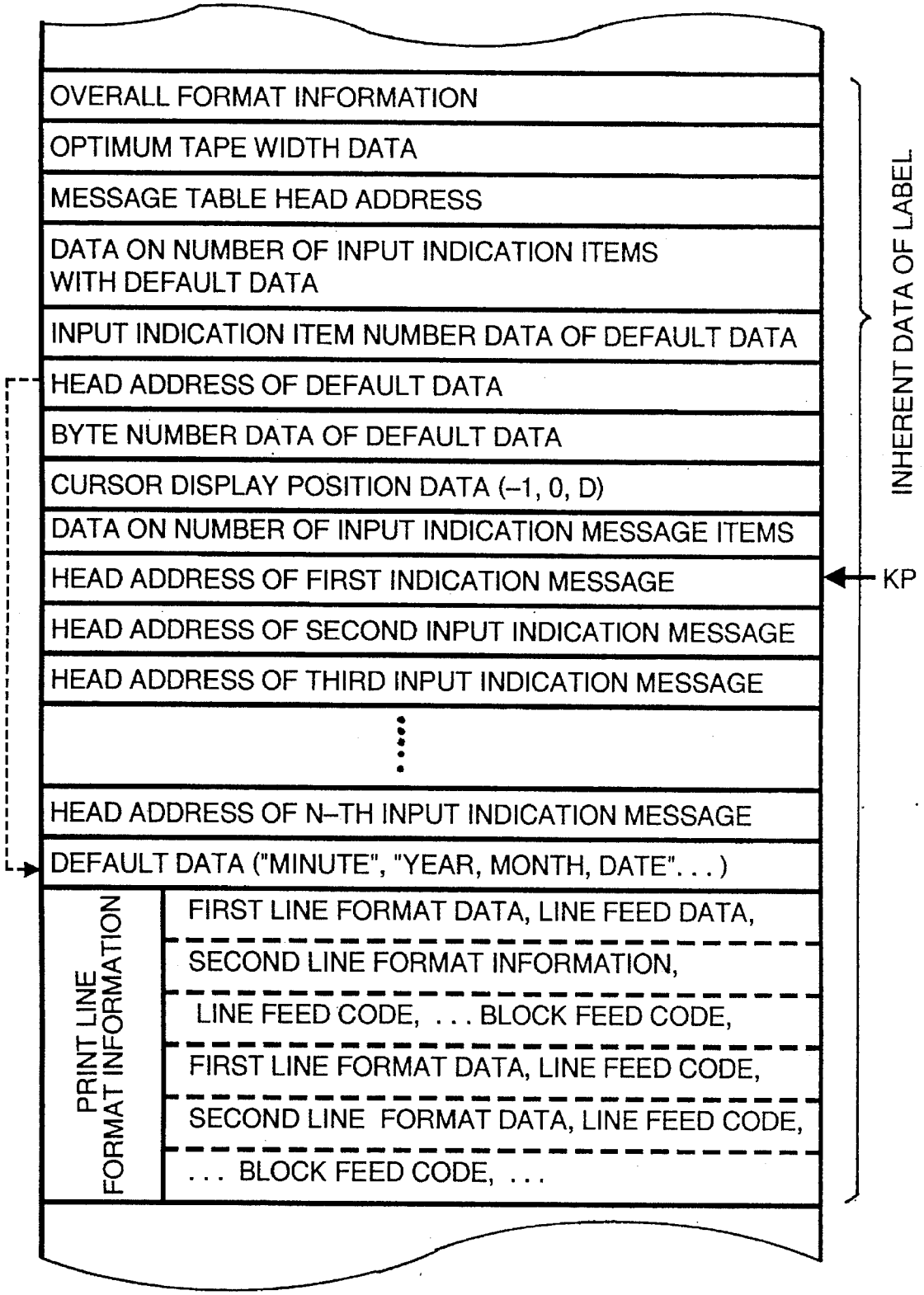
FIG. 5 is a table showing the data structure of an inherent information table of the data structure of FIG. 4.
Figure 7A:
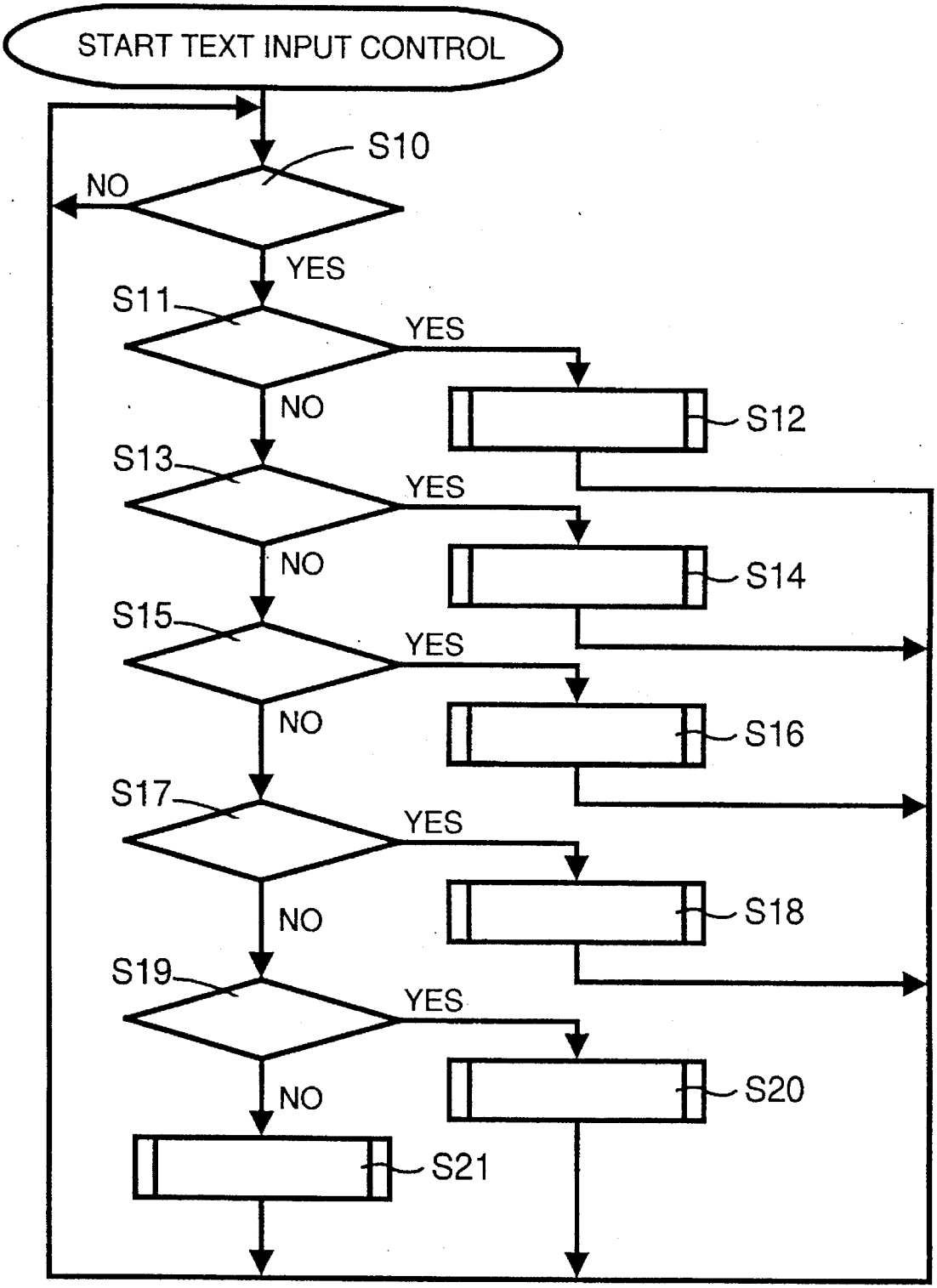
FIG. 7A is a flowchart for a text input control routine.

As shown in FIG. 5, each of the plural label inherent data contains overall format information (see FIG. 11) which is a part of the fixed format information for the label printing, data on a tape width which is optimum to the label printing, a head address of a message table, input indication item number data having default data which are specific characters and symbols such as "minute", "year, month, date" which are preset for printing, input indication item number data having default data, data on the head address of the default data, the byte number of the default data and the display position of the cursor, the head address in the input indication message table of each input indication message, plural default data, and line format data of each line every block data while partitioning the line format data with a line feed code or a block feed code. As cursor display position data, "−1" indicates the end of a line, "0" indicates the head of a line and D indicates the display column position.

Some fixed label names which can be formed by the tape-shaped label forming device 1 will be briefly described with reference to FIGS. 6A and 6B.

The registered label name "call the registered file" which is formed and registered by an user is displayed with the label number set to "−1" and the text data set as the input indication message. The optimum tape width is the tape width of a cassette tape which is mounted in the thermal print mechanism.

For the fixed label names such as "video VHS tape" (label number of "0"), "video 8 mm&Hi8 case" (label number of "2"), and "video VHS-C case" (label number of "4") "symbol ?", "title ?", "comment ?", "recording time", "standard ?" and "recording date" are set as first to sixth input indication messages respectively, and the optimum tape width is set to "18 mm" or "12 mm". Furthermore, the input indication messages for the fixed label names "video 8 mm&Hi8 tape" (label number of "1"), "audio cassette tape" (label number of "5"), "audio DAT tape" (label number of "7") , "name, name plate", (label number of "9", "10"), "management fixtures" (label number of "11", "12"), and the optimum tape width are set as shown in FIGS. 6A and 6B.

Besides, as other fixed label names are prepared, many fixed label names, such as "floppy 3.5 inches", "floppy 5 inches", "price card", "document address", and "letter address", are also possible The RAM 50 contains a text memory 51, having first and second areas 51A,51B to be discussed later, for storing the code data of characters which are input from the keyboard 3 through the text input control and text data which are input from the keyboard 3 incident to the input indication messages through the fixed-type label data input control, a first overall format information memory 52 for storing overall format information on a selected label name, a second overall format information memory 53 for storing overall format information which is overall format information on a selected label name and is subjected to alteration processing, a pointer memory 54 for storing the pointer value LP of a label pointer for successively indicating labels stored in the label index tape and the pointer value KP of an input indication item pointer for successively indicating input indication messages stored in the input indication message table, a tape information memory 55 for storing the tape width data of the laminate tape 11 of the tape cassette 10 mounted in the thermal print mechanism PM, a registered file memory 56 for storing registered files which are registered by a user, a print data buffer 57 for developing and storing the dot pattern data corresponding to character codes stored in the text memory 51 for the registered files, and a work memory for temporarily storing a calculation result which is calculated in the CPU 40.

Next, the routines for the text input control (which is a main routine), the fixed-type label forming control, the label name selection control and the fixed format information altering control will be described with reference to the flowcharts and tables of labels of FIGS. 7A to 10B. In the figures, Si (i=10, 11, 12, . . . ) represents a step.

Upon turning on the power source using the power source key on the keyboard 3, a normal text input control for inputting document data is first started to display a text input frame on the display 4. When the printable keys other than the editing keys, such as the character keys, the numeral keys, the symbol keys, the line feed key and the block feed key are manipulated (S10, S11: Yes), the code data corresponding to the input keys are stored as document data in the text memory 51 and characters, numbers and symbols corresponding to the manipulated keys are displayed on the display 4 (S12). Thereafter, the process returns to step S10.

If the memory key is manipulated (S11: No; S13: Yes), the document data stored in the text memory 51 are subjected to register processing to register the document data in the registered file memory 56 (S14) and the process returns to step S10. If the print key is manipulated (S11,S13:No; S15:Yes), the document data of a selected file of a plurality of files which are stored in the text memory 51 or the registered file memory 56 through a data input operation are subjected to print processing (S16) and the process returns to step S10.

If the fixed-type label forming key is manipulated in order to designate a desired label which is to be stuck on, for example, a video tape, an audio tape or a case therefor (S11,S13,S15:No; S17:Yes), the fixed-type label forming control (see FIGS. 8A and 8B) is started and executed (S18).

If the fixed format altering key is manipulated (S11,S13, S15,S17:No; S19:Yes), the fixed format information altering control for altering the fixed format information on the selected label name is executed. (S20), and then the process returns to step S10. If keys other than the above keys are manipulated, processing corresponding to the manipulated key is executed (S21).

Figure 8A:
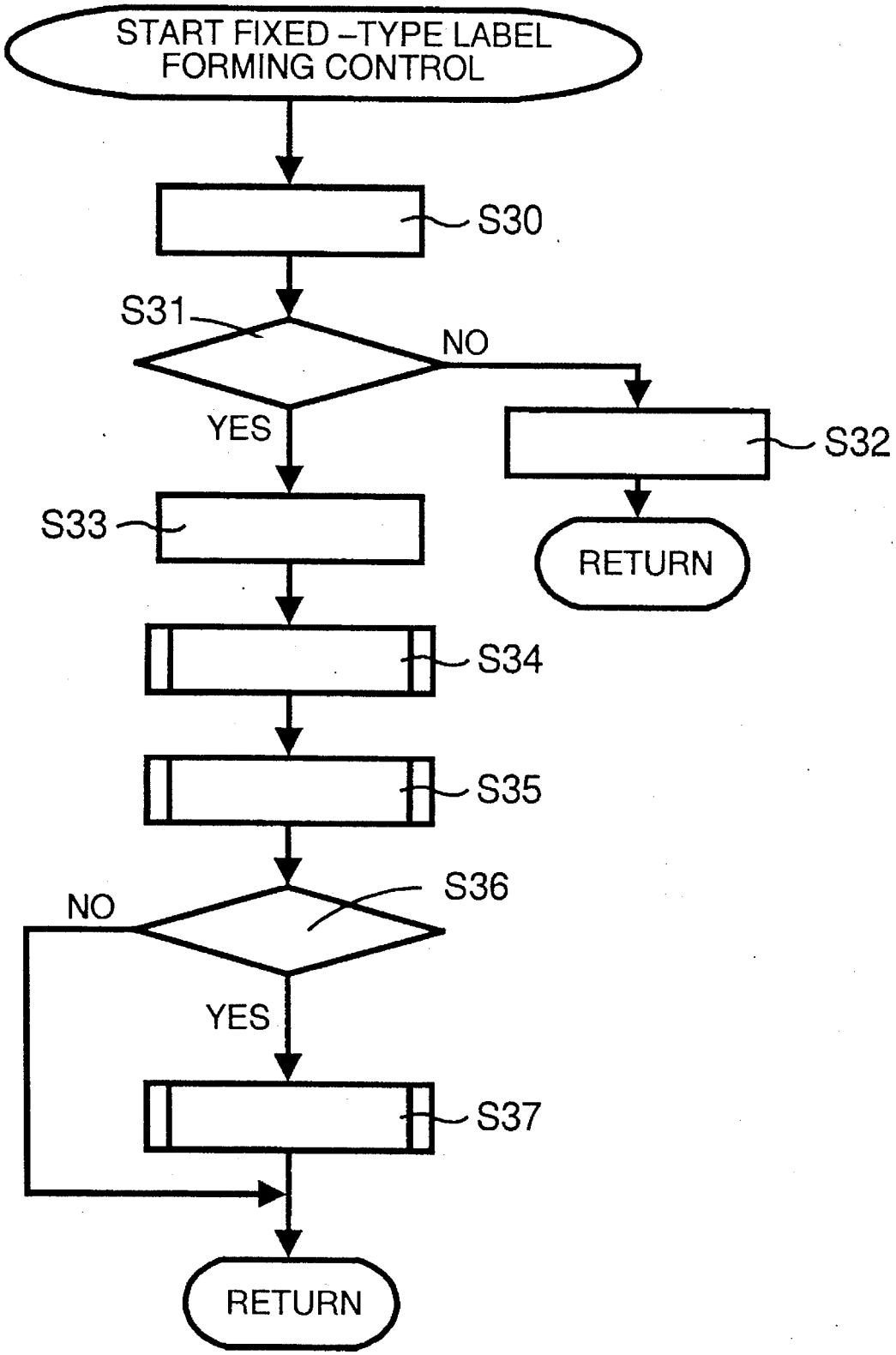
FIG. 8A is a flowchart for a subroutine of a fixed label forming control.

As shown in FIGS. 8A,8B, upon start of the fixed-type label forming control (which corresponds to the control in the fixed format mode), tape cassette information is first read out from the cassette sensor 30 and stored in the tape information memory 55 (S30). If a tape cassette 10 is judged to be mounted on the basis of the tape cassette information (S31: Yes), the label pointer LP indicates the label name "call registered file" at the head of the label index table, as shown in FIG. 4, and the label name selection frame is displayed on the display 4 (S33). Subsequently, the label name selection control (see FIGS. 9A and 9B), described later, is executed (S34). For example, when the label name selection frame is displayed in S33, the first label name "call registered file", which is formed and registered by the user, is displayed on a display area 4B at the lower stage of the display 4 on the basis of the label pointer value LP. However, when no tape cassette 10 is mounted (S31:No), an error message "no tape is mounted" is displayed on the display 4 for a prescribed period (S32), and the process ends the fixed-type label forming control and returns to the main routine.

Figure 9A:
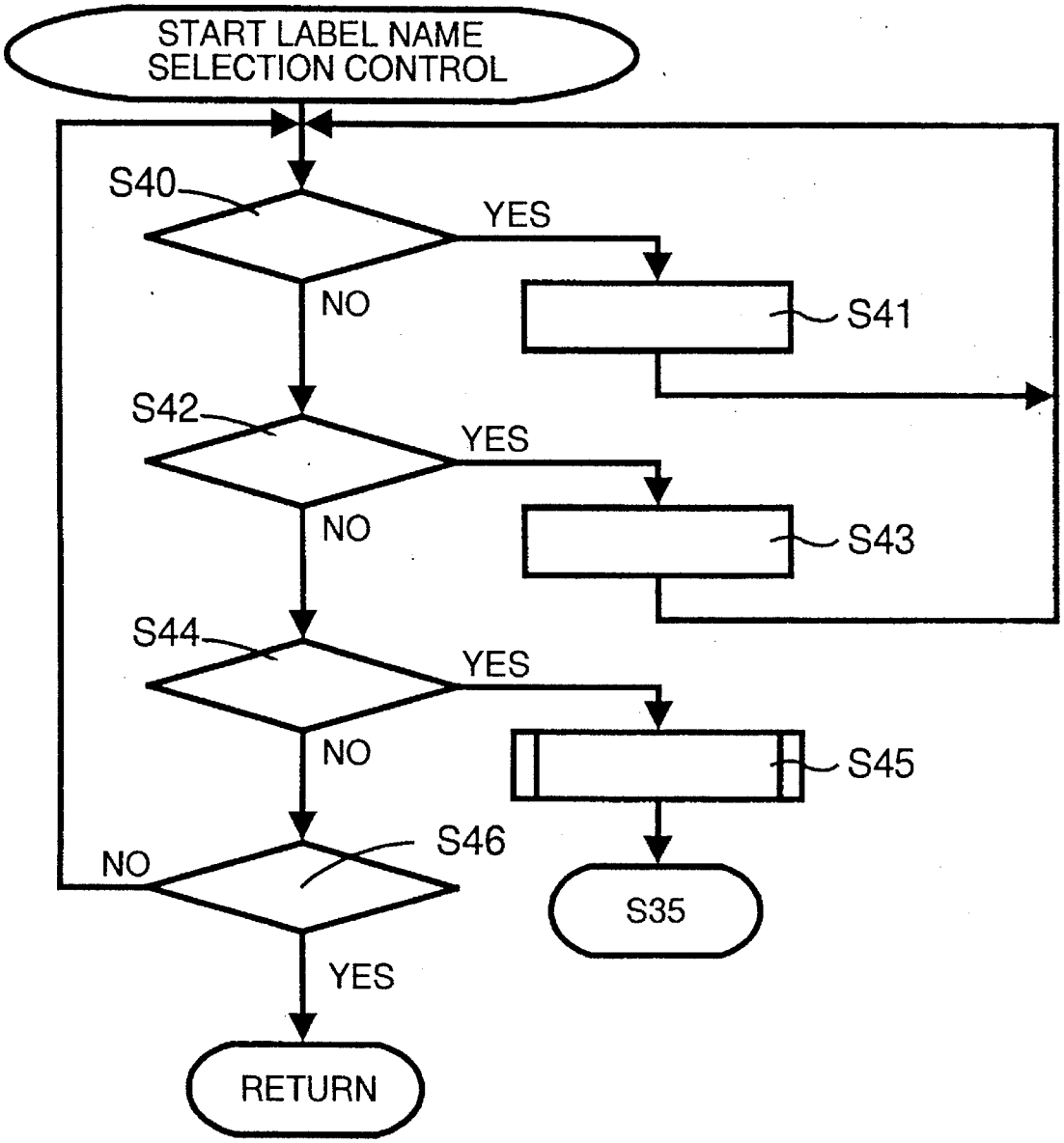
FIG. 9A is a flowchart for a subroutine of a label name selection control.

The label selection control will be described in detail with reference to FIGS. 9A,9B.

If a cursor down-shift key is manipulated in a state where the label name selection frame is displayed on the display 4 (S40: Yes), the next label name is displayed (S41) and then the process returns to step S40. If a cursor up-shift key is manipulated (S40:No; S42: Yes), a previous label name is displayed (S43) and the process returns to step S40. If the enter key is manipulated to select a desired label name while the label name is displayed (S40,S42:No; S44: Yes), the fixed format information developing processing is executed (S45) and the process goes to S35.

If the enter key is not manipulated and the cancel key is manipulated (S46: Yes), the process returns to the main routine. If cancel key is also not manipulated, the process returns to step S40.

In the fixed format information developing processing of step S45, the overall format information for the selected label name is read out from the ROM 43 and is transmitted to and stored into the first overall format information memory 52. In addition, the line format information for the selected label name is read out from the ROM 43 and transmitted to and stored into the first area 51A of the text memory 51.

Next, the fixed-type label data input processing (step S35 of FIGS. 8A,8B) of the label name selection control will be described. The first input indication message for the selected label name is displayed in a display area 4A at the upper stage of the display 4, and upon input of the text data corresponding to the message, the data are stored in a memory portion which is prior to the line feed code of the line format data at the first area 51A of the text memory 51. Subsequently, a second input indication message is displayed through the manipulation of the cursor down-shift key, and the input processing of the fixed-type label data are successively executed through the input of the text data and the manipulation of the cursor down-shift key in the same manner as described above.

When the user determines not to form a label of the selected label name in the fixed format and wants to form the label in a format which is obtained by altering the fixed format, the fixed-type label formation releasing key is manipulated (S36: Yes) to execute a fixed format information transmission control (S37), and then the process returns to the main routine.

In the fixed format information transmission control, the overall format information for the selected label is read out from the ROM 43 and is transmitted to and stored into the second overall format information memory 53. Further, the line format information for the selected label name is read out from the ROM 43 and transmitted to and stored into the second area 51B of the text memory 51.

The overall format information and the line format information will now be briefly described. FIG. 11 shows a plurality of items or elements of the overall format information (ruled line, arrangement, blank, . . . ) and a plurality of parameters for each item. The underlined parameters are default parameters which are set in the fixed format information.

When the user manipulates the fixed format altering key to alter the fixed format information (S19 in the main routine: Yes), the fixed format information altering control is executed (S20), and then the process returns to S10.

Figure 10A:
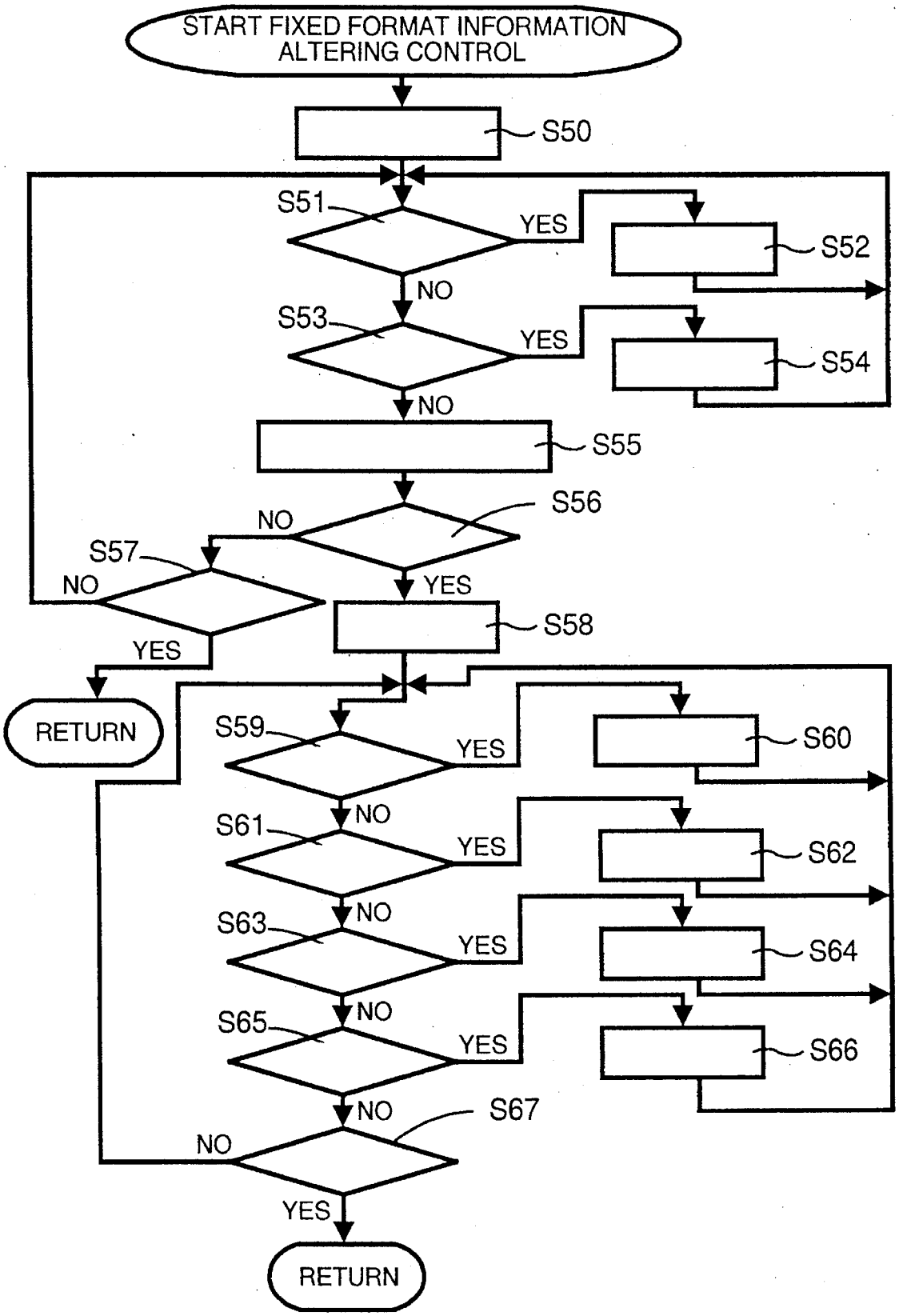
FIG. 10A is a flowchart for a subroutine of a fixed format information altering control.

The fixed format information altering control will be described in detail with reference to FIGS. 10A,10B.

An object to be altered (alteration target) in this control is the overall format information stored in the second overall format information memory 53 of the RAM 50 and the line format information stored in the second area 51B of the text memory 51. Upon the start of control, the first item of the overall format information (item of ruled lines) is displayed in the display area 4A at the upper stage of the display 4. A piece of format information which is set for an item to be displayed is read out from the overall format information stored in the second overall format information memory 53. The read-out format information is displayed in a display area 4B at the lower stage of the display (S50). At first, the fixed format information corresponds to the set format information, however, the altered format information corresponds to the set format information after the format information is altered.

When the cursor down-shift key is manipulated (S51: Yes), a next item of the overall format information and a piece of format information which is set for the item are read out from the second overall format information memory 53 and displayed in the same manner as described above (S52). On the other hand, when the cursor up-shift key is manipulated (S51: No; S53: Yes), the previous item of the overall format information and a piece of format information which is set for the item are read out from the second overall format information memory 53 and displayed in the same manner as described above (S54).

In step S55, parameters for each item of the overall format information are selectively set through the manipulation of the enter key, and the format information is rewritten. In this case, the parameters of each item are switched as follows. The cursor right shift key is manipulated to switch to a parameter on a next line, and the cursor left shift key is manipulated to switch to a parameter on a previous line. Through this operation, each parameter which is finally selected is set as the selected parameter. If neither the line format key nor the end key is manipulated after the processing of the step S55 (S56:No; S57:No), the process returns to step S51, and the processing of the step S51 and subsequent processing thereto are repeated. If the end key is manipulated (S57:Yes), the process returns to the main routine.

As described above, in the case where the format information is altered for one or a plurality items of the overall format information and then the line format information is altered, the initial frame for the line format setting is displayed by manipulating the line format key (S56:Yes) and the size setting mode is set by manipulating the size key (S59:Yes), so that the format information on the character size is altered and set through the key manipulation and the display (S60). Thereafter, the process returns to the step S59.

Figure 13:
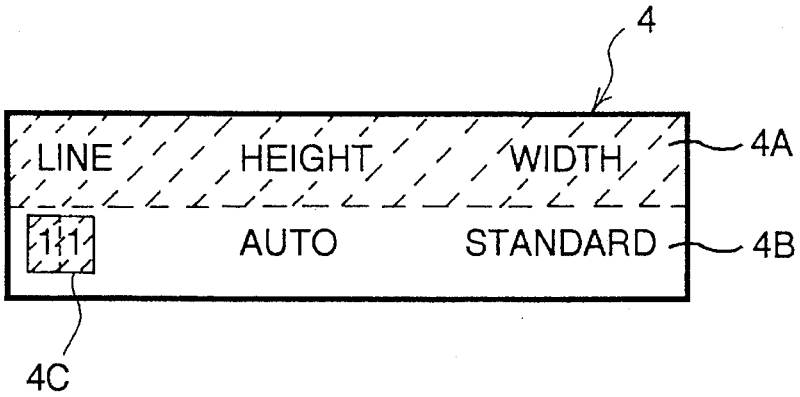
FIG. 13 is a diagram showing a first display example on a display.

In this case, a display, such as shown in FIG. 13, is provided on the display 4. In this display, "1" at the left side of a column "line" of display area 4B represents a block number while "1" at the right side thereof represents a line number, and a cursor 4C represents a line number. The format information "auto" and "standard" for the first line of a first block of the fixed format which is stored in the second area of the text memory 51 in step S37 is first displayed for the height and width of characters, respectively.

Figure 14:
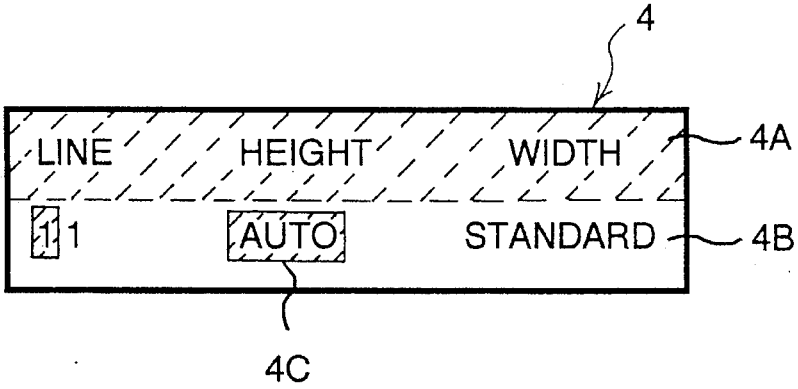
FIG. 14 is a diagram showing a second display example on the display.
Figure 15:
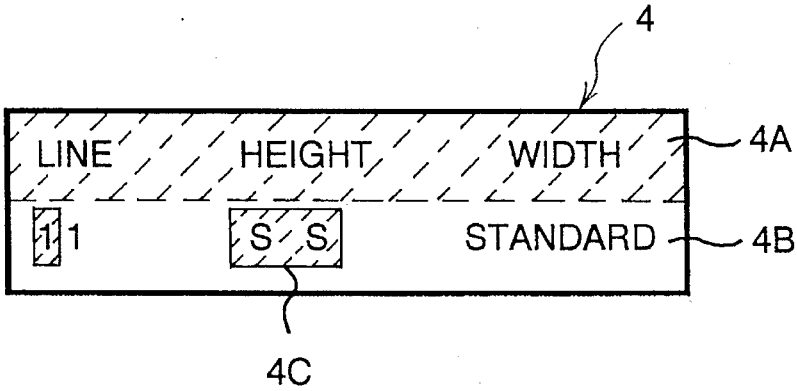
FIG. 15 is a diagram showing a third display example on the display.

The cursor 4C is cyclically shifted in the following order: "line", "height" and "width" by manipulating the cursor right shift key. Accordingly, by shifting the cursor 4C to the column "height" and then manipulating the cursor down-shift key as shown in FIG. 14, the parameter on "height", as shown in FIGS. 12A and 12B, is switched from "auto" to "SS" as shown in FIG. 15. If the enter key is manipulated in the above state, the "height" can be set to "SS". In this case, the set data are stored into the text memory 51. If the cursor up-shift key is manipulated, the parameter is returned to a previous parameter.

Likewise, when the character width is altered and set, the cursor 4C is shifted to the column "width" to alter the parameter to a parameter such as "long body", "flat body" or the like.

Figure 16:
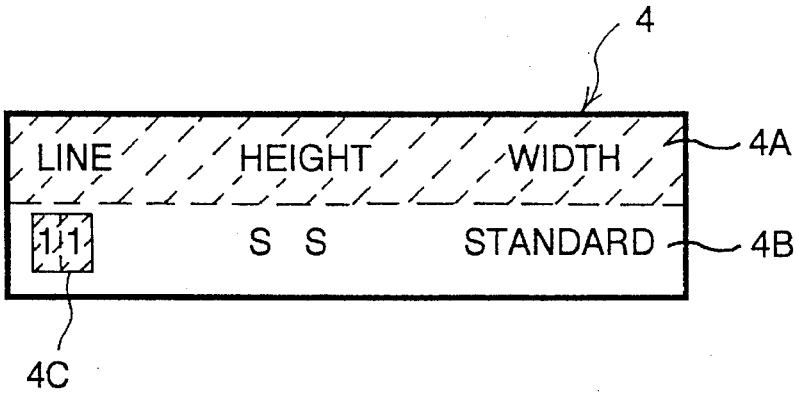
FIG. 16 is a diagram showing a fourth display example on the display.

The above setting is performed for the line format of the first line of the first block because the block number is set to "1" and the line number is set to "1". In order to switch the line format to that of the second line, the cursor right-shift key is manipulated to switch the display state to a state as shown in FIG. 16, and then the cursor down-shift key is manipulated to switch the line number to "2", whereby the format information on the line format of the second line of the first block can now be altered and set in the same manner as described above.

Further, in order to switch the first block to the second block, the code key and the cursor down-shift key are manipulated to switch to a next block number.

Next, returning to FIGS. 10A,10B, when a decoration key is manipulated to alter and set the format information for various decorations to be applied to characters (S59:No; S61:Yes), a decoration setting mode is set and the format information for a decoration of an indicated line of an indicated block stored in the second area 51B of the text memory 51 is altered and set through the key manipulation and display (S62) in the same manner as the step S60. Thereafter, the process returns to step S59.

Upon manipulation of the font key to alter font information on the format (S59,S61:No; S63:Yes), a font setting mode is set, and the format information for the font of an indicated line of an indicated block, which is stored in the second area 51B of the text memory 51, is altered and set through the key manipulation and the display (S64) in the same manner as at step S60. Thereafter, the process returns to step S59.

When the other format keys are manipulated to alter the other format information (arrangement, vertical writing, ruled line) (S59,S61,S63:No; S65:Yes), the other format setting modes are set respectively, and the format information on the other formats of an indicated line of an indicated block, which is stored in the second area of the text memory 51, is altered (S66) in the same manner as in the step S60 and the process returns to step S59.

Upon manipulation of the end key to end the alteration processing of the line format information as described above (S59,S61,S63,S65:No; S67:Yes), the process returns to the main routine.

Here, it is assumed that the text data (fixed-type label data) which have been already input in the first area of the text memory 51 are entirely transmitted to the second area and stored at the corresponding position of the corresponding block (not shown). In order to further add text data, the text data are input through steps S10, S11 and S12 of the main routine, and stored at the corresponding position of the second area of the text memory.

When the label printing is performed, the printing operation is performed on the basis of the text data stored in the second area of the text memory and the format information.

Figure 17:
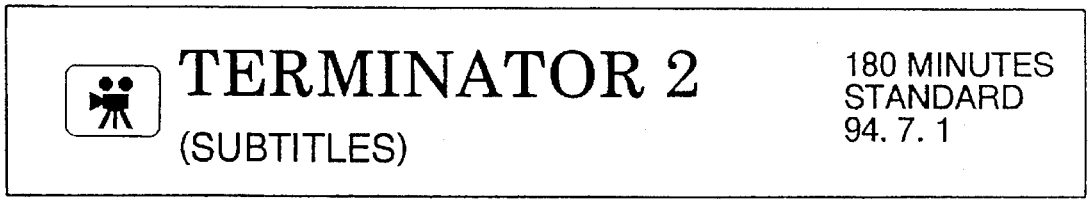
FIG. 17 is a diagram showing a print example in which a label is printed in a fixed format.
Figure 18:
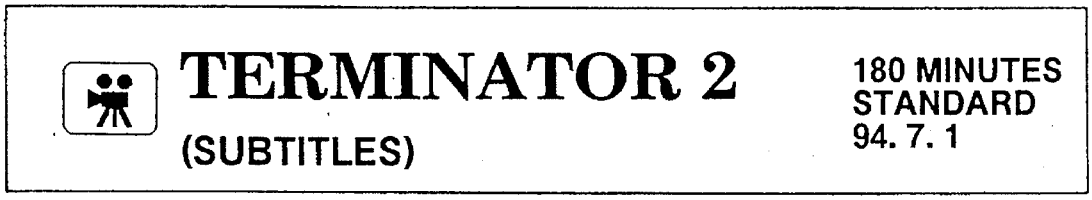
FIG. 18 is a diagram showing a print example in which a label is printed in an altered format.

FIG. 17 shows a print example in which the fixed-type label having the label name "video VHS tape" is printed in a fixed format with the text data added and FIG. 18 is a print example in which the same label is printed in a format which is obtained by altering only the font of the fixed format.

Next, the effect of the tape-shaped forming device as described above will be described.

The RAM 50 is provided with the second overall format memory. The overall format information of the fixed format information for printing which is stored in the ROM 43 can be transmitted to and altered in the second overall format memory 53, so that the alteration is added to the overall format information of the fixed format and can be put to practical use. Therefore, the work efficiency for the setting of the overall format information can be improved over a case where the overall format information is newly and separately prepared. Thus, the document processing efficiency can be improved.

This effect can be obtained for the line format information of the fixed format information. That is, the text memory 51 is provided with the second area, and the line format information of the fixed format information for printing, which is stored in the ROM 43, can be transmitted to and altered in the second area. Therefore, the alteration is added to the fixed line format information and it can be put to practical use. Therefore, the work efficiency for the setting of the line format information can be improved over a case where the line format information is created anew for each label. As a result, the document processing efficiency can be improved.

The invention is not limited to the above embodiment and the following modifications, such as partial alteration, may be made to the above embodiment.

1) In the above embodiment, the first overall format memory 52 and the second overall format memory 53 are provided independently of each other for the sake of description. However, the device may be designed so that the first overall format memory 52 is omitted and the second overall format memory 53 is commonly used. Likewise, the first area and the second area are independently provided to the text memory 51. However, the device may be designed so that the first area is omitted and the second area is commonly used.

2) In the above embodiment, the tape-shaped label forming device is representatively used as the document processing document. However, the invention is applicable to various document processing devices, such as a word processor and a personal computer. Further, the invention may be applied to techniques of altering and setting various fixed format information, such as a fixed format for post cards, a fixed format for address printing, and other various fixed formats for fixed-type label formation, in the document processing devices as described above.

3) When the document processing device has a large-size display, the format information for printing may be collectively displayed in one or plural frames on the display and then altered.

As described above, the following effects can be obtained according to the invention.

According to the document processing device as described above, in addition to the fixed format mode setting means and the non-volatile fixed format information memory, there are provided the format information memory which serves to store the format information for input data printing and is provided in the text memory and the format information transmission means for reading in the fixed format information of the fixed format information memory and transmitting it to the format information memory. Therefore, the fixed format information of the fixed format information memory is transmitted to the format information memory, the fixed format information transmitted to the format information memory is altered and the printing operation performed using the altered format information. As a result, the load for the format setting work for printing is reduced and the work efficiency for format setting is improved. Particularly, the format setting can be easily performed, even by a beginner and the operator can easily handle the document processing device.

According to the document processing device as described above, there is provided the mode release means for releasing the fixed format mode which is set by the fixed format mode setting means and instructing the format information means to transmit the fixed format information, so that the fixed format information can be transmitted to the format information memory in parallel to the release of the fixed format mode.

According to the document processing device as described above, there is provided the format information altering control means for displaying on the display the fixed format information which is transmitted to the format information memory by the format information transmission means, and allowing the fixed format information to be altered through the input means, so that the fixed format information can be displayed on the display and the alteration of the fixed format information can be easily and highly efficiently performed.

What is claimed is:

1. A document processing device, comprising:

input means for inputting data comprising at least characters and various instructions as input data;

display means for displaying the input characters;

a text memory for storing the input data;

control means for controlling the input means, the text memory, the display means and the print means;

fixed format mode setting means for setting a fixed format mode to print the input data in a fixed format, wherein each fixed format defined elements of a label for a specific use in which input data fills in the elements;

a non-volatile fixed format information memory in which fixed format information for printing the input data in a prescribed preset fixed format is stored;

a format information memory provided in said text memory stores fixed format information to print the input data when the fixed format mode is set;

format information transmission means for reading the fixed format information defining the elements of the label from said fixed format information memory and transmitting the fixed format information to said format information memory; and format information altering control means for displaying on a display the fixed format information which is transmitted by said format information transmission means to said format information memory and allowing the fixed format information of the elements to be altered through said input means.

2. The document processing device as claimed in claim 1, further comprising mode releasing means for releasing the fixed format mode which is set by said fixed format mode setting means and permitting the fixed format information to be transmitted by said format information transmission means to said format information memory.

3. The document processing device claimed in claim 1, further comprising print means for printing the input data stored in said text memory.

4. The document processing device as claimed in claim 3, wherein said print means comprises:

a print member having a plurality of print elements; and a print cassette containing a tape for being printed upon.

5. The document processing device as claimed in claim 1, wherein each fixed format constitutes a format previously stored in said non-volatile fixed format information memory to predetermine acceptable input data for each element.

6. The document processing device as claimed in claim 1, wherein each fixed format defines a printed product having an elongated, rectangular shape.

7. A print processing device, comprising:

input means for inputting character data and instructions as input data;

a display having a cursor;

an input memory for storing the input data;

a non-volatile memory storing a plurality of fixed formats for labels, each fixed format having at least one defined element and said non-volatile memory additionally storing information requirements for the at least one defined element of each fixed format of the plurality of fixed formats;

a working memory;

a fixed format selecting means for selecting from the plurality of fixed formats;

altering means for altering the selected one of the plurality of fixed formats; and a controller for controlling all elements of said print processing device.

8. The print processing device as claimed in claim 7, further comprising a print element, wherein the input data is printed by said print element in the selected fixed format or according to the instructions.

9. The print processing device as claimed in claim 8, wherein the format and the input data are combined in said work memory to create print data for printing by said print element.

10. The print processing device as claimed in claim 7, wherein each format of the plurality of fixed formats has a plurality of attributes, each attribute having a default value to define the fixed format.

11. The print processing device as claimed in claim 10, wherein at least one of the plurality of attributes for each fixed format has alternative settings that can be set by said altering means.

12. The print processing device as claimed in claim 7, wherein a format, as well as input data, can be input using said input means to create a user defined format.

13. The print processing device as claimed in claim 7, wherein said display has at least two sections, a first section for displaying information requirements and print processing device generated messages and a second section for displaying input data.

14. The print processing device as claimed in claim 7, wherein the print processing device is a tape printer for printing information on a tape.

15. The print processing device as claimed in claim 14, wherein the tape has one of a plurality of widths and further comprising a sensor for detecting a width of the tape.

16. The print processing device as claimed in claim 14, wherein each fixed format of the plurality of fixed formats defines a label for a specific use.

* * * * *